US009799291B2

(12) United States Patent
Hung et al.

(10) Patent No.: US 9,799,291 B2
(45) Date of Patent: Oct. 24, 2017

(54) PIXEL DRIVING CIRCUIT AND DRIVING METHOD THEREOF

(71) Applicant: AU Optronics Corporation, Hsin-Chu (TW)

(72) Inventors: Chia-Che Hung, Hsin-Chu (TW); Tokuro Ozawa, Hsin-Chu (TW); Chia-Ting Hsieh, Hsin-Chu (TW); Bo-Shiang Tzeng, Hsin-Chu (TW); Chia-Wei Kuo, Hsin-Chu (TW); Chih-Lung Lin, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 15/172,853

(22) Filed: Jun. 3, 2016

(65) Prior Publication Data

US 2017/0154591 A1 Jun. 1, 2017

(30) Foreign Application Priority Data

Nov. 27, 2015 (TW) ..... 104139731 A

(51) Int. Cl.
*G09G 3/36* (2006.01)

(52) U.S. Cl.
CPC ..... *G09G 3/3659* (2013.01); *G09G 3/3677* (2013.01); *G09G 3/3688* (2013.01); *G09G 2300/0819* (2013.01); *G09G 2310/0202* (2013.01); *G09G 2310/061* (2013.01)

(58) Field of Classification Search
None
See application file for complete search history.

(56) References Cited

U.S. PATENT DOCUMENTS

2004/0257353 A1* 12/2004 Imamura ..... G09G 3/3233 345/204
2005/0269959 A1* 12/2005 Uchino ..... G09G 3/2011 315/169.3
2010/0259531 A1* 10/2010 Ono ..... G09G 3/3233 345/212
2011/0254871 A1 10/2011 Yoo et al.
2012/0086694 A1 4/2012 Tseng et al.
(Continued)

FOREIGN PATENT DOCUMENTS

TW 201222511 A 6/2012
TW I430255 3/2014

*Primary Examiner* — Nicholas Lee
(74) *Attorney, Agent, or Firm* — WPAT, PC

(57) ABSTRACT

A pixel driving circuit includes a first capacitor, a data input unit, a liquid crystal capacitor, a control unit and a driving unit. The first capacitor has a first terminal and a second terminal, wherein the first terminal is configured for receiving a first reference voltage. The data input unit is configured for inputting a data signal to the second terminal of the first capacitor according to a first scanning signal. The liquid crystal capacitor has a first terminal and a second terminal. The first terminal receives a first operating signal. The control unit is configured to control a voltage of the second terminal of the liquid crystal capacitor according to a second scanning signal. The driving unit is configured to control the voltage of the second terminal of the liquid crystal capacitor in response to the data input unit is disabled by the first scanning signal.

20 Claims, 16 Drawing Sheets

(56) References Cited

U.S. PATENT DOCUMENTS

| | | | | |
|---|---|---|---|---|
| 2012/0169798 | A1* | 7/2012 | Ebisuno | G09G 3/325 345/690 |
| 2012/0320293 | A1 | 12/2012 | Wang et al. | |
| 2013/0057532 | A1* | 3/2013 | Lee | G09G 3/3225 345/211 |
| 2014/0361964 | A1 | 12/2014 | Lin et al. | |

* cited by examiner

PIXEL DRIVING CIRCUIT AND DRIVING METHOD THEREOF

RELATED APPLICATIONS

This application claims priority to Taiwan Application Serial Number 104139731, filed Nov. 27, 2015, which is herein incorporated by reference.

BACKGROUND

Technical Field

The present invention relates to a kind of pixel driving circuit and its driving method. More particularly, the present invention relates to a pixel driving circuit and its driving method less affected by high-frequency effects.

Description of Related Art

Televisions and tablet computers with liquid crystal display (LCD) are popular recently, and technology of LCD develops rapidly. In general, the liquid crystal display is able to show different grayscales by providing data signals to control the degree of deflection of liquid crystal (LC) molecules.

However, to let LCDs have higher resolutions and higher refresh rate, the LCDs require scan signals and data signals with higher operating frequency. The operating frequency influences a dielectric coefficient of liquid crystal molecules. When the operating frequency is higher, the dielectric coefficient will be lower. When the dielectric coefficient is reduced, a capacitance of the LC decreases, such that a stored charge between two terminals of the LC capacitor will drop. The reduced voltage difference between two terminals of the LC capacitor caused by inadequate charge further influences a deflection of LC molecules and a grayscale display function of the LCD.

One of known solutions is implementing additional storage capacitors to stabilize aforesaid dropping of the voltage difference. However, it requires a large area to implement these storage capacitors, so as to cause a severe loss of aperture ratio of the display device, especially for applications with a high operating frequency (e.g., field sequential display) or applications with a high dielectric coefficient (e.g., blue phase liquid crystal or ferroelectric liquid crystal).

Besides, sub-threshold currents of driving transistors in the pixel circuit induce over-charge voltages to the LC capacitors and also lead to excessive power consumption. Also, a threshold voltage of the driving transistor under a long-term current stress will lead to a deviation problem.

SUMMARY

The disclosure provides a pixel driving circuit and a driving method thereof. An aspect of the disclosure is a pixel driving circuit, which includes a first capacitor, a data input unit, a liquid crystal capacitor, a driving unit and a control unit. The first capacitor includes a first terminal configured to receive a first reference voltage and a second terminal. The data input unit is electrically coupled to the first capacitor, wherein the data input unit is configured to input a data signal to the second terminal of the first capacitor according to a first scanning signal. The liquid crystal capacitor includes a first terminal configured to receive a first reference voltage and a second terminal. The driving unit is electrically coupled to the data input unit, the second terminal of the first capacitor, and the second terminal of the liquid crystal capacitor, wherein in response to the data input unit being disabled, the driving unit is configured to control the voltage of the second terminal of the liquid crystal capacitor according to the data signal. The control unit is electrically coupled to the driving unit, wherein the control unit is configured to generate a second scanning signal for resetting the voltage of the second terminal of the liquid crystal capacitor.

Another aspect of the disclosure is a pixel driving circuit, which includes a first capacitor, a data input unit, a liquid crystal capacitor, a control unit and a driving unit. The first capacitor includes a first terminal configured to receive a first reference voltage and a second terminal. The data input unit is electrically coupled to the first capacitor, wherein the data input unit is configured to input a data signal to the second terminal of the first capacitor according to a first scanning signal. The liquid crystal capacitor includes a first terminal configured to receive a first reference voltage and a second terminal. The control unit is electrically coupled to the liquid crystal capacitor, wherein the control unit is configured to generate a second scanning signal for resetting the voltage of the second terminal of the liquid crystal capacitor. The driving unit is electrically coupled to the data input unit, the second terminal of the first capacitor, and the second terminal of the liquid crystal capacitor, wherein in response to the data input unit being disabled, the driving unit is configured to control the voltage of the second terminal of the liquid crystal capacitor according to the data signal.

Still another aspect of the disclosure is a driving method for driving first, second, third, and fourth aforesaid pixel driving circuits. The data input unit of the first and the second pixel driving circuit are configured to receive a first scanning signal of the first row. The data input unit of the third and the fourth pixel driving circuit are configured to receive a first scanning signal of the second row. The data input unit of the first and the third pixel driving circuit are electrically coupled to a first data line. The data input unit of the second and the fourth pixel driving circuit are electrically coupled to a second data line. The driving method includes following steps. An enabling pulse is provided to the first scanning signal of the first row for enabling the data input unit of the first and the second pixel driving circuits. A first data signal with a first voltage level is provided to the first capacitor of the first pixel driving circuit. A first driving current of the first pixel driving circuit is detected. The first driving current is generated according to the first data signal and the first driving current flows through the driving unit of the first pixel driving circuit. A display signal is received. A second data signal is provided to the first capacitor of the first pixel driving circuit according to the driving current of the first pixel driving circuit.

It will be understood that the above description of embodiments is given by way of example only and that various modifications may be made by those with ordinary skill in the art. The above specification, examples and data provide a complete description of the structure and use of exemplary embodiments of the disclosure. Although various embodiments of the disclosure have been described above with a certain degree of particularity, or with reference to one or more individual embodiments, those with ordinary skill in the art could make numerous alterations to the disclosed embodiments without departing from the spirit or scope of this disclosure, and the scope thereof is determined by the claims that follow.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1A:
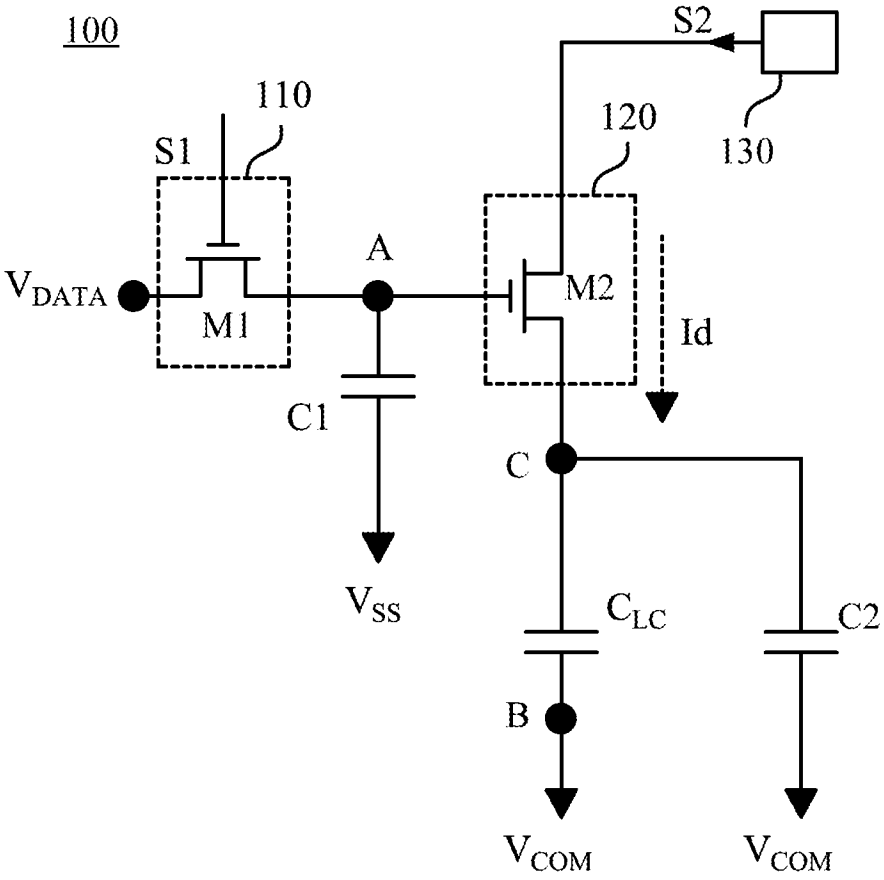
FIG. 1A is a schematic diagram of a pixel driving circuit according to one embodiment of the disclosure.

The following disclosure provides many different embodiments, or examples, for implementing different features of the disclosure. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Reference is made to FIG. 1A, which is a schematic diagram of a pixel driving circuit 100 according to one embodiment of the disclosure. In practice, the pixel driving circuit 100 is configured for a liquid crystal display (LCD), wherein the LCD can be television screens, computer screens, cellphone screens, touchscreens and other display screens. However, examples of the present disclosure are not so limited. The LCD includes multiple pixel driving circuits 100 to compose a complete display screen.

Reference is made to FIG. 1A, the pixel driving circuit 100 includes a first capacitor C1, a data input unit 110, a liquid crystal capacitor $C_{LC}$, a driving unit 120, and a control unit 130.

The capacitor C1 includes a first terminal configured to receive a reference voltage $V_{SS}$, and a second terminal A. In this embodiment, the reference voltage $V_{SS}$ is at logic-low level. In other embodiments, the reference voltage $V_{SS}$ can be at any voltage level; examples of the present disclosure are not so limited.

The data input unit 110 is electrically coupled to the first capacitor C1, and the data input unit 110 inputs a data signal $V_{DATA}$ into the second terminal A of the first capacitor C1 according to a first scanning signal S1. In this embodiment, the data input unit 110 includes a first transistor M1, and the first transistor M1 includes a first terminal configured to receive the data signal $V_{DATA}$, a second terminal electrically coupled to the driving unit 120 and the second terminal A of the first capacitor C1, and a control terminal configured to receive the first scanning signal S1.

The liquid crystal capacitor $C_{LC}$ includes a first terminal B configured to receive an operating signal $V_{COM}$, and a second terminal C. Liquid crystal molecules exist between liquid crystal capacitors $C_{LC}$, and the liquid crystal capacitor $C_{LC}$ is able to control the deflection of liquid crystal molecules to be positive or negative according to the voltage difference between the first terminal B and the second terminal C. For example, in response to the positive voltage difference between the first terminal B and the second terminal C of the liquid crystal capacitor $C_{LC}$, the liquid crystal molecules are controlled to deflect positively, and in response to the negative voltage difference between the first terminal B and the second terminal C of the liquid crystal capacitor $C_{LC}$, the liquid crystal molecules are controlled to deflect negatively. Note that the degree of deflection (i.e., the degree of positive or negative deflection) will further influence the grayscale effect of the LCD. In some embodiments, in response to the maximal positive deflection of liquid crystal molecules, the LCD shows a substantially pure black screen, while in response to the maximal negative deflection of liquid crystal molecules, the LCD shows a substantially pure white screen. The LCD shows a screen of a gray color between pure white and pure black in response to an intermediate degree of deflection of liquid crystal molecules.

In other embodiments, the liquid crystal molecules may be controlled to deflect positively in response to the negative voltage difference between the first terminal B and the second terminal C of the liquid crystal capacitor $C_{LC}$, and the liquid crystal molecules may be controlled to deflect negatively in response to the positive voltage difference between the first terminal B and the second terminal C of the liquid crystal capacitor $C_{LC}$; examples of the present disclosure are not so limited.

The driving unit 120 is electrically coupled to the data input unit 110, the second terminal A of the first capacitor C1 and the second terminal C of the liquid crystal capacitor $C_{LC}$, wherein in response to the first scanning signal S1 disabling the data input unit 110, the driving unit 120 is configured to control the voltage of the second terminal C of the liquid crystal capacitor $C_{LC}$ according to the data signal $V_{DATA}$. In this embodiment, the driving unit 120 includes a second transistor M2, wherein the second transistor M2 includes a first terminal, a second terminal electrically coupled to the second terminal C of the liquid crystal capacitor $C_{LC}$, and a control terminal electrically coupled to the data input unit 110 and the second terminal A of the first capacitor C1. As shown in FIG. 1A, the first transistor M1 and the second transistor M2 are regarded as p-type transistors, namely the control terminal of the first transistor M1 and the second transistor M2 are enabled by positive voltage level. The second transistor M2 may act as a source follower which ideally provides output terminal thereof a voltage substantially identical to its input terminal.

In practice, the first transistor M1 and the second transistor M2 may be n-type Metal-Oxide-Semiconductor Field-Effect Transistors (nMOSFETs), p-type Metal-Oxide-Semiconductor Field-Effect Transistors (pMOSFETs), n-type bipolar junction transistors, p-type bipolar junction transistors, or other equivalent transistors; examples of the present disclosure are not so limited. The embodiment including n-type transistors is shown in FIG. 10 (transistor M1' and M2'), and the details will be given afterwards.

The control unit 130 is electrically coupled to the driving unit 120, wherein the control unit 130 is configured to generate a second scanning signal S2 for resetting the voltage of the second terminal C of the liquid crystal capacitor $C_{LC}$.

Figure 1B:
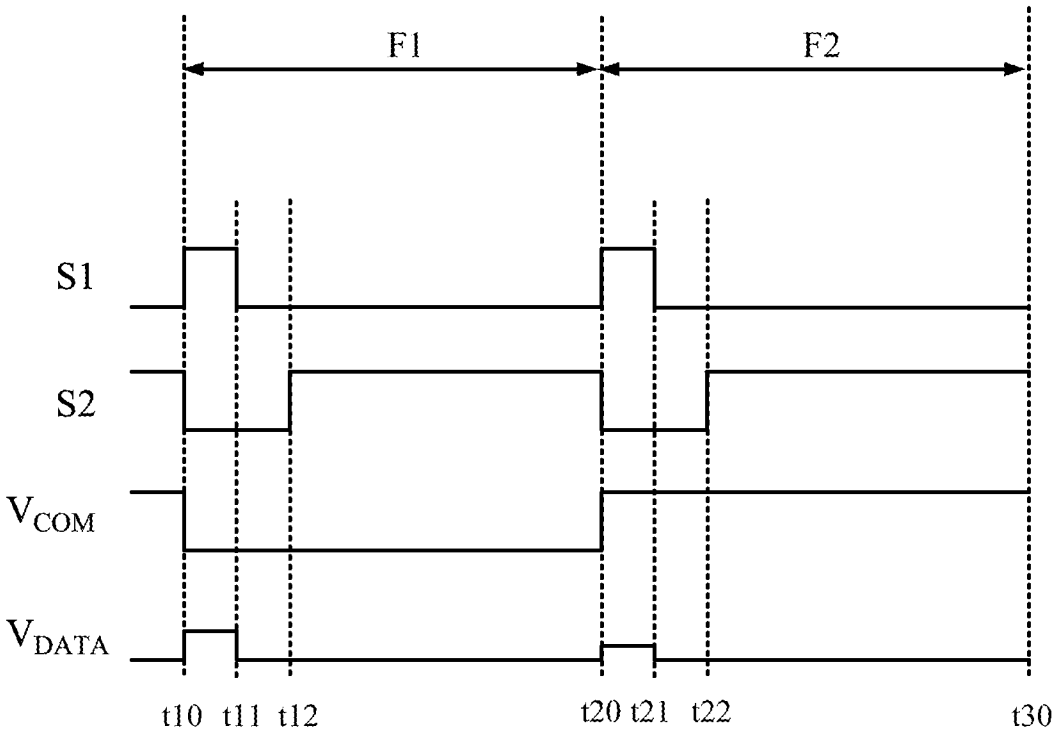
FIG. 1B is a timing diagram of the operation waveform of the pixel driving circuit shown in FIG. 1A.
Figure 1C:
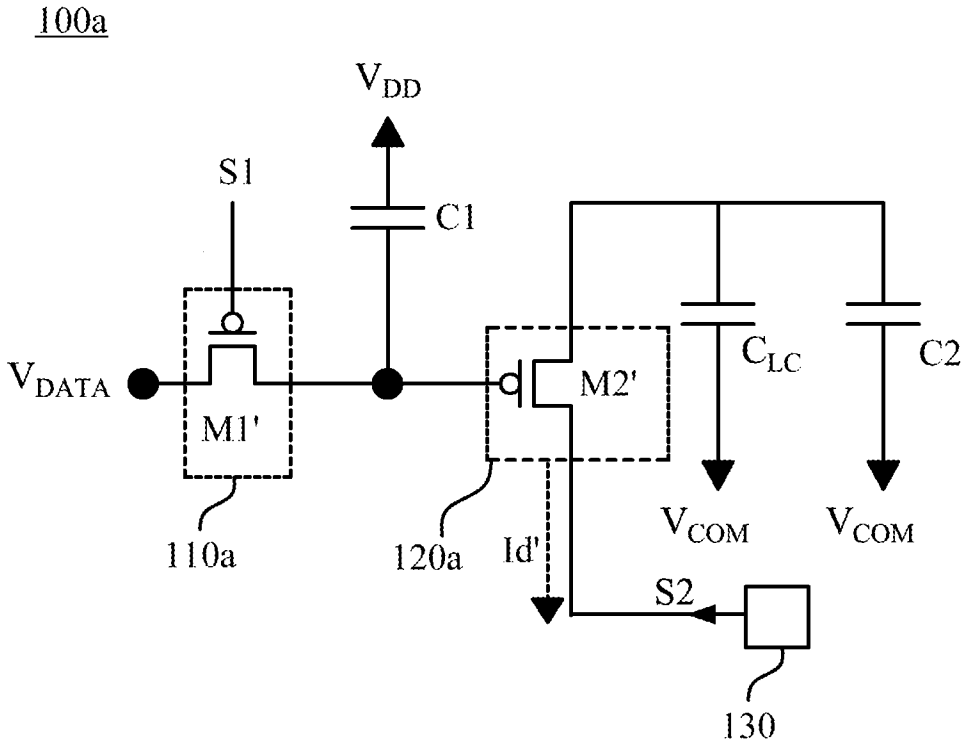
FIG. 1C is a schematic diagram of a pixel driving circuit according to another embodiment of the disclosure.

Reference is made to both FIG. 1A and FIG. 1B. FIG. 1B is a timing diagram of the operation waveform of the pixel driving circuit shown in FIG. 1A. In response to the first scanning signal S1 enabling the data input unit 110 (for example, but not limited to, during the time interval t10~t11 in the first frame F1 and the time interval t20~t21 in the second frame F2 shown in FIG. 1B), the data signal $V_{DATA}$ is provided to the second terminal A of the first capacitor C1 via the data input unit 110 and stored in the first capacitor C1. The driving unit 120 controls the voltage of the second terminal C of the liquid crystal capacitor $C_{LC}$ according to the second scanning signal S2. At this moment, although the control terminal of the second transistor M2 of the driving unit 120 receives the data signal $V_{DATA}$ and the second transistor M2 is turned on, the second scanning signal S2 received by the first terminal of the second transistor M2 is at disabling voltage level. The default level of disabling voltage level is set to be logic-low level in this embodiment, namely the second terminal C of the liquid crystal capacitor $C_{LC}$ can be reset to logic-low level by the driving unit 120 with the second transistor M2 turned on. In other embodiments, the voltage level configured to reset the second terminal C of the liquid crystal capacitor $C_{LC}$ (i.e., default level) can be logic-high level or other suitable voltage level; examples of the present disclosure are not so limited.

In these time intervals (the time interval t10~t11 in the first frame F1 or the time interval t20~t21 in the second frame F2), the driving unit 120 will not generate the driving current Id, the driving unit 120 will only reset the voltage of the second terminal C of the liquid crystal capacitor $C_{LC}$ and store the data signal $V_{DATA}$ in the first capacitor C1. Therefore, these time intervals are also called "data input & reset periods." Besides, the second transistor M2 of the above driving unit 120 adopts a circuit structure of a source follower, that is, the gate (control terminal) of the second transistor M2 serves as the input terminal, and the source (second terminal) of the second transistor M2 serves as the output terminal.

Figure 2A:
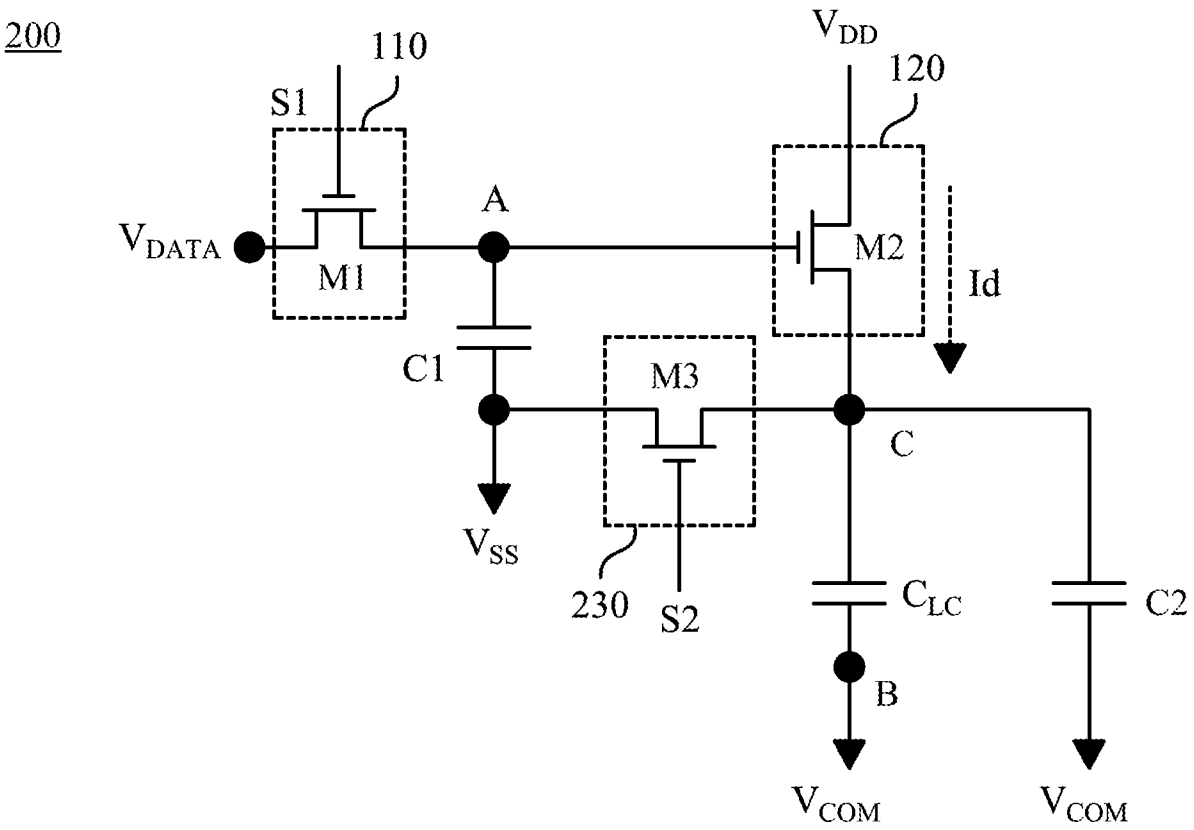
FIG. 2A is a schematic diagram of a pixel driving circuit according to another embodiment of the disclosure.

Then, after the first scanning signal S1 is disabled, the control unit 130 enables the second scanning signal S2 received by the second transistor M2 (for instance, during the time interval t12~t20 in the first frame F1 or the time interval t22~t30 in the second frame F2 as shown in FIG. 1B). In this embodiment, the control unit 130 is electrically coupled to the first terminal of the second transistor M2, and in some embodiments, the control unit 130 may be electrically coupled to the second terminal of the second transistor M2, as shown in FIG. 2A. Because the data signal $V_{DATA}$ is stored in the first capacitor C1 in the previous time interval, such as the time interval t10~t11 in the first frame F1 or the time interval t20~t21 in the second frame F2, in response to the second scanning signal S2 being enabled, the second transistor M2 of the driving unit 120 provides the driving current Id for charging the liquid crystal capacitor $C_{LC}$. The voltage of the second terminal C of the liquid crystal capacitor $C_{LC}$ is charged from the previously reset voltage level (such as logic-low level) to a target voltage level corresponding to the data signal $V_{DATA}$. Furthermore, the voltage of the second terminal C of the liquid crystal capacitor $C_{LC}$ can be shown as:

$$V_C = V_{DATA} - V_{th} \tag{1}$$

wherein $V_C$ is the voltage of the second terminal C of the liquid crystal capacitor $C_{LC}$, $V_{DATA}$ is the data signal, $V_{th}$ is the threshold voltage of the second transistor M2 of the driving unit 120.

Generally speaking, the ideal threshold voltage $V_{th}$ of the second transistor M2 is a constant, thus the second transistor M2 is only affected by different data signals $V_{DATA}$ while charging the second terminal C of the liquid crystal capacitor $C_{LC}$ to the above voltage level $V_C$. For example, when the data signal $V_{DATA}$ is 1V, the second transistor M2 charges the liquid crystal capacitor $C_{LC}$ to 0.5V, and when the data signal $V_{DATA}$ is 2V, the second transistor M2 charges the liquid crystal capacitor $C_{LC}$ to 1.5V, so as to control the degree of deflection of liquid crystal molecules (namely the degree of positive or negative deflection). The description of these embodiments of the present disclosure is for purpose of illustration only and not intended to limit the disclosure.

Besides controlling the degree of deflection of liquid crystal molecules (namely the degree of positive or negative deflection) by the voltage of the second terminal C of the liquid crystal capacitor $C_{LC}$, in this embodiment, the polarity of liquid crystal molecules deflection can be controlled via the operating signal $V_{COM}$ received by the first terminal B of the liquid crystal capacitor $C_{LC}$. That is, switch the liquid crystal molecules from positive deflection to negative deflection or from negative deflection to positive deflection.

For example, the operating signal $V_{COM}$ is at logic-low level in the first frame F1 and at logic-high level in the second frame F2, as shown in FIG. 1B. The deflection of liquid crystal molecules can be positive when the operating signal $V_{COM}$ is at logic-low level, and the degree of positive deflection can be further altered by the voltage of configured to of the liquid crystal capacitor $C_{LC}$. In a similar manner, the deflection of liquid crystal molecules can be switched from positive to negative when the operating signal $V_{COM}$ is at logic-high level, and the degree of negative deflection can be further altered by the voltage of configured to of the liquid crystal capacitor $C_{LC}$. In other embodiments, the positive deflection and negative deflection of liquid crystal molecules can respectively correspond to the operating signal $V_{COM}$ at logic-high level, logic-low level, or any arbitrary level; examples of the present disclosure are not so limited.

As mentioned above, the voltage difference between the first terminal B and the second terminal C of the liquid crystal capacitor $C_{LC}$ will affect the degree of deflection of liquid crystal molecules (i.e., the degree of positive or negative deflection), and further influence the grayscale effect of the LCD. Thus, after the second transistor M2 has charged the liquid crystal capacitor $C_{LC}$ to the above-mentioned target voltage level, a illumination unit (not shown) of the LCD will display in grayscale in this time interval (i.e., the time interval t12~t20 in the first frame F1 or the time interval t22~t30 in the second frame F2), and this time interval is also called "emission period."

From the embodiment shown in FIG. 1A and FIG. 1B, even if the frequency of the first scanning signal S1 and the data signal $V_{DATA}$ are very high, namely the active period of the first scanning signal S1 is very short (i.e., the time interval t10~t11 in the first frame F1 or the time interval t20~t21 in the second frame F2 is very short), the pixel driving circuit 100 will not be affected. The first scanning signal S1 first stores the data signal $V_{DATA}$ in the first capacitor C1, thus when the first scanning signal S1 disables the data input unit 110, the driving unit 120 can still continuously charge the liquid crystal capacitor $C_{LC}$. In addition, in some embodiments, the pixel driving circuit 100 further includes a second capacitor $C_2$ electrically coupled in parallel to the liquid crystal capacitor $C_{LC}$, as shown in FIG. 1A. The second capacitor $C_2$ can be configured to stabilize the voltage level of the liquid crystal capacitor $C_{LC}$ after the liquid crystal capacitor $C_{LC}$ has been charged to the above-mentioned target voltage level.

Figure 1D:
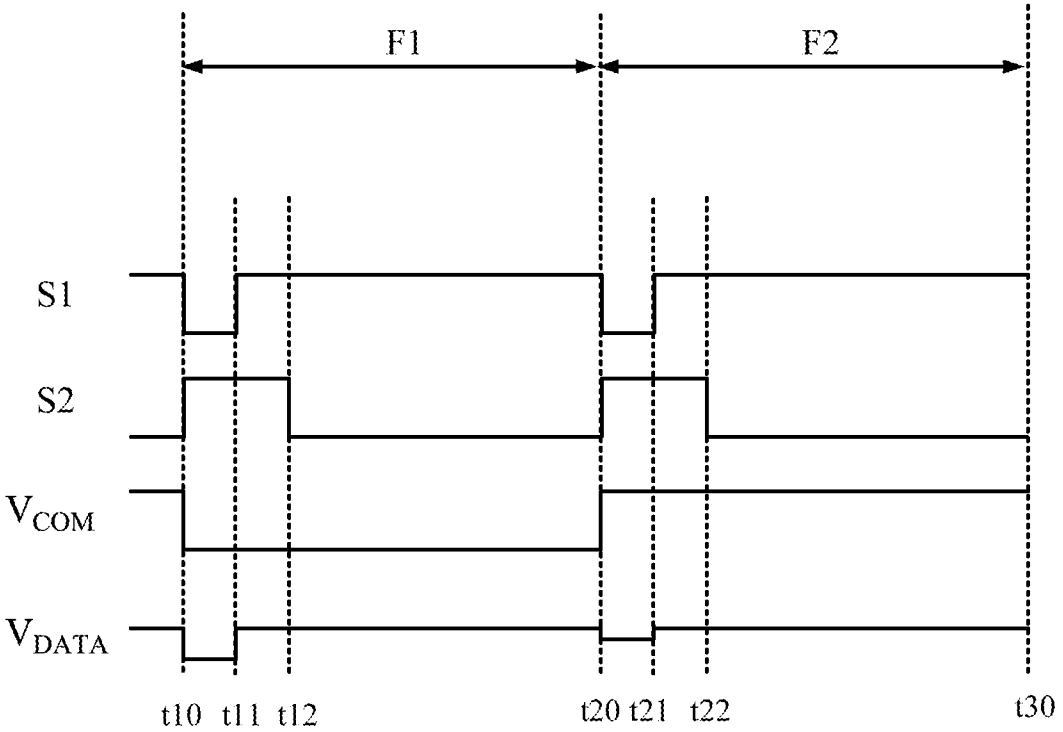
FIG. 1D is a timing diagram of the operation waveform of the pixel driving circuit shown in FIG. 1C.

Reference is made to FIG. 10 and FIG. 1D. FIG. 10 is a schematic diagram of a pixel driving circuit 100*a* according to another embodiment of the disclosure. FIG. 1D is a timing diagram of the operation waveform of the pixel driving circuit 100*a* shown in FIG. 10. The difference between the pixel driving circuit 100*a* in FIG. 10 and the pixel driving circuit 100 in FIG. 1A is that the transistors M1' and M2' in the data input unit 110*a* and driving unit 120*a* are n-type transistors, that is, the control terminals of the transistor M1' and M2' are enabled by negative voltage level. The reference voltage $V_{DD}$ received by the first capacitor C1 is at logic-high level in this embodiment, and can be logic-low level or any arbitrary level in other embodiments; examples of the present disclosure are not so limited.

Therefore, the main difference between the pixel driving circuit 100 and the pixel driving circuit 100*a* is the enabling voltage level of the transistors M1 and M2 in the data input unit 110 and the driving unit 120, and the enabling voltage level of transistors M1' and M2' in the data input unit 110*a* and the driving unit 120*a*. Note that the driving current Id' in the pixel driving circuit 100*a* flows reversely to the driving current Id in the pixel driving circuit 100. Other operations of the pixel driving circuit 100*a* (such as reset, data input, and grayscale display) are similar to the pixel driving circuit 100. Likewise, in this embodiment, the second transistor M2' in the driving unit 120*a* adopts the circuit structure of the source follower, namely the gate (control terminal) of the second transistor M2' serves as the input terminal, and the source (second terminal) of the second transistor M2' serves as the output terminal.

Figure 2B:
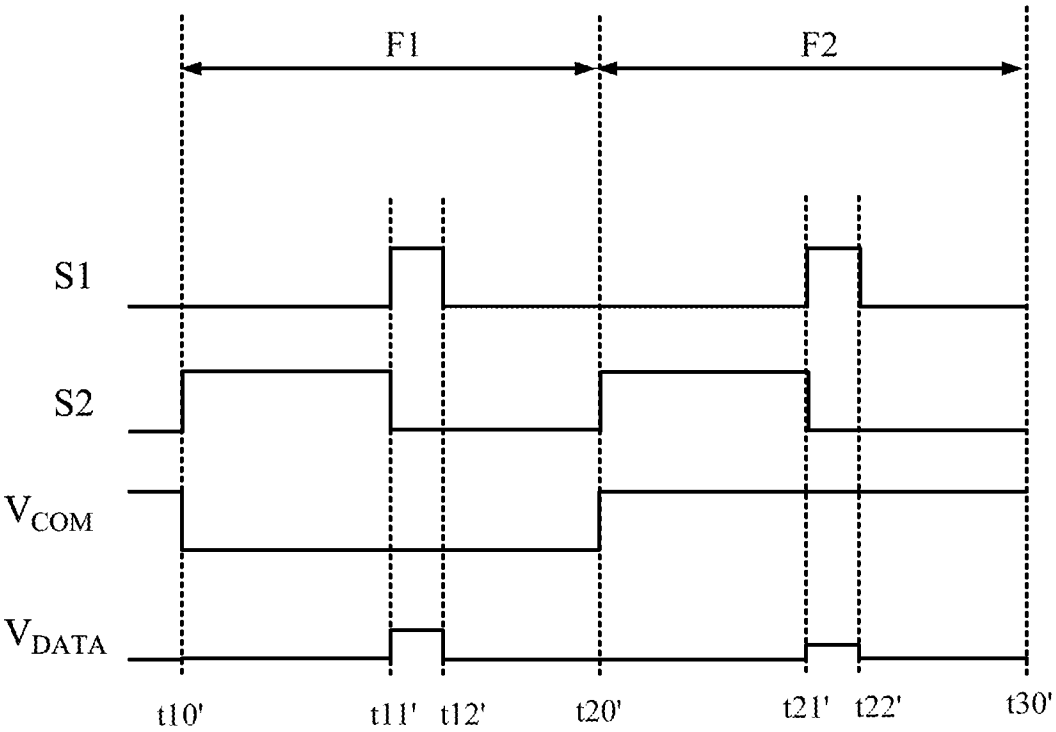
FIG. 2B is a timing diagram of the operation waveform of the pixel driving circuit shown in FIG. 2A.

Reference is made to FIG. 2A and FIG. 2B. FIG. 2A is a schematic diagram of a pixel driving circuit 200 according to another embodiment of the disclosure. FIG. 2B is a timing diagram of the operation waveform of the pixel driving circuit 200 shown in FIG. 2A. The previously mentioned control unit 130 of the pixel driving circuit 100 in FIG. 1A is electrically coupled to the first terminal of the second transistor M2, and the control unit 130 provides the second scanning signal S2 to the first terminal of the second transistor M2. Yet in FIG. 2A, a control unit 230 of the pixel driving circuit 200 is electrically coupled to the second terminal of M2. Furthermore, the control unit 230 includes a third transistor M3. The third transistor M3 includes a first terminal electrically coupled to the first terminal of the first capacitor C1, a second terminal electrically coupled to the driving unit 120 and the second terminal C of the liquid crystal capacitor $C_{LC}$, and a control terminal configured to receive the second scanning signal S2.

Besides, as shown in FIG. 2B, in this embodiment, the second scanning signal S2 is enabled during the time interval t10'~t11' in the first frame F1 or the time interval t20'~t21' in the second frame F2. The third transistor M3 is turned on and the voltage of the second terminal C of $C_{LC}$ is reset to the voltage level of the reference voltage $V_{SS}$. The process of data inputting (during the time interval t11'~t12' in the first frame F1 or the time interval t21'~t22' in the second frame F2) and grayscale displaying (during the time interval t12'~t20' in the first frame F1 or the time interval t22'~t30' in the second frame F2) are conducted subsequently. The operations of the pixel driving circuit 200 are similar to the pixel driving circuit 100.

From the embodiment shown in FIG. 2A and FIG. 2B, even if the frequency of the first scanning signal S1 and the data signal $V_{DATA}$ are very high, namely the active period of the first scanning signal S1 is very short (i.e., the time interval t10~t11 in the first frame F1 or the time interval t20~t21 in the second frame F2 is very short), the pixel driving circuit 100 will not be affected significantly. The first scanning signal S1 first store the data signal $V_{DATA}$ in the first capacitor C1, thus at the moment that the first scanning signal S1 disables the data input unit 110, the driving unit 120 can still continuously charge the liquid crystal capacitor $C_{LC}$. Likewise, in this embodiment, the second transistor M2 in the driving unit 120 adopts the circuit structure of the source follower, namely the gate (control terminal) of the second transistor M2 serves as the input terminal, and the source (second terminal) of the second transistor M2 serves as the output terminal.

Figure 2C:
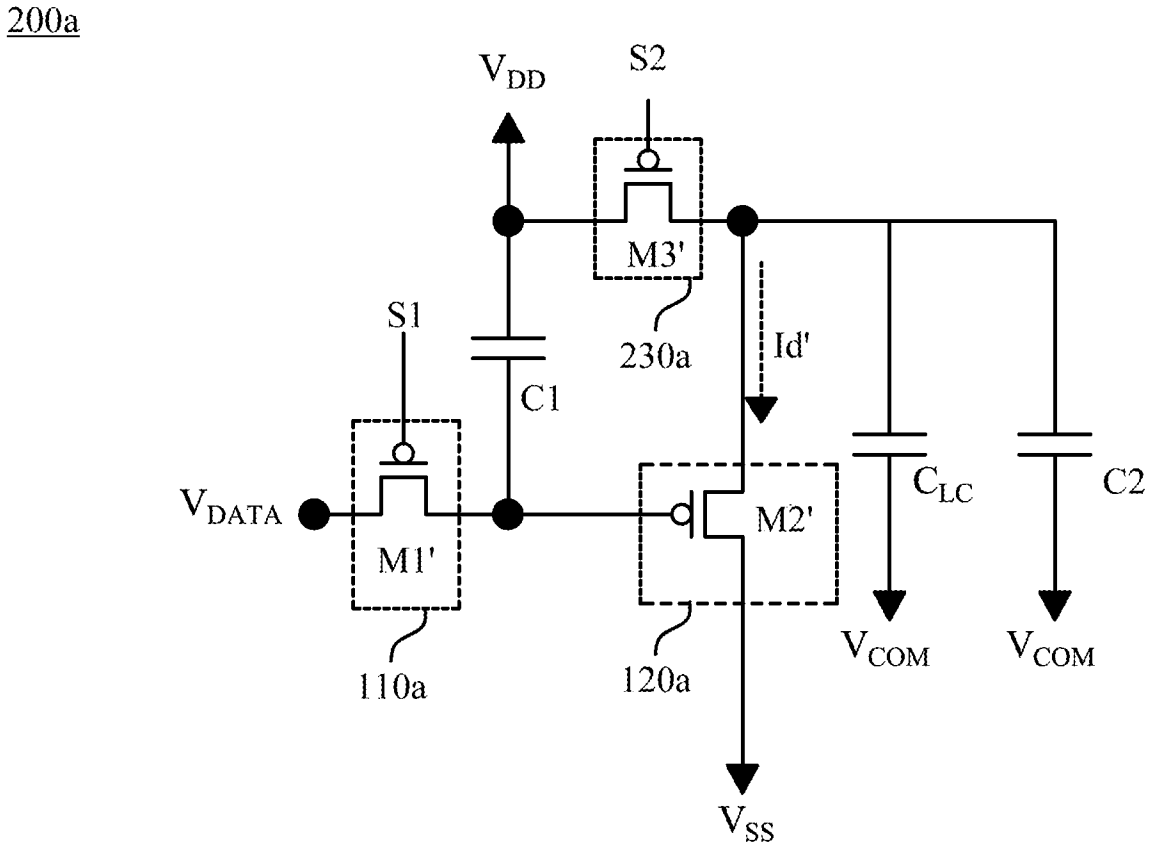
FIG. 2C is a schematic diagram of a pixel driving circuit according to another embodiment of the disclosure.
Figure 2D:
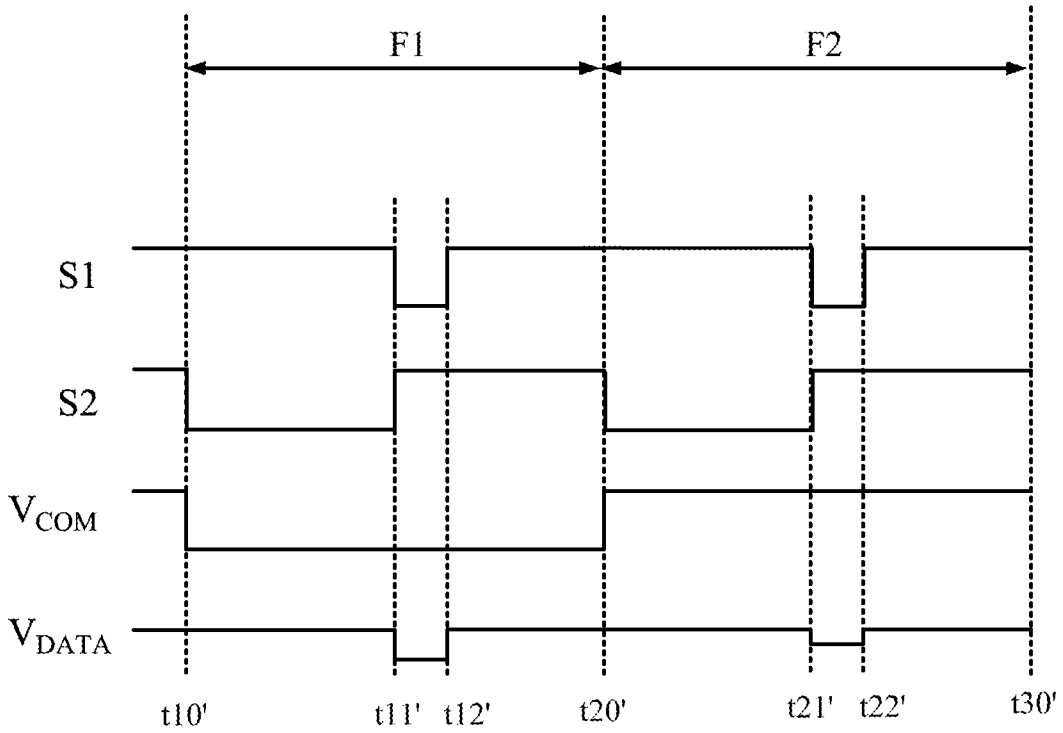
FIG. 2D is a timing diagram of the operation waveform of the pixel driving circuit shown in FIG. 2C.

Reference is made to FIG. 2C and FIG. 2D. FIG. 2C is a schematic diagram of a pixel driving circuit 200*a* according to another embodiment of the disclosure. FIG. 2D is a timing diagram of the operation waveform of the pixel driving circuit 200*a* shown in FIG. 2C. The difference between the pixel driving circuit 200*a* in FIG. 2C and the pixel driving circuit 200 in FIG. 2A is mainly that the transistors M1', M2', and M3' of the data input unit 110*a*, the driving unit 120*a* and the control unit 230*a* are n-type transistors, that is, the control terminals of the transistor M1', M2', and M3' are enabled by negative voltage level. The reference voltage $V_{DD}$ received by the first capacitor C1 is at logic-high level in this embodiment, and the reference voltage $V_{DD}$ can be logic-low level or any arbitrary level in other embodiments; examples of the present disclosure are not so limited.

Therefore, the main difference between the pixel driving circuit 200 and the pixel driving circuit 200*a* is the enabling voltage level of the transistors M1, M2, M3 of the data input unit 110, the driving unit 120 and the control unit 230 and the enabling voltage level of the transistors M1', M2', M3' of the data input unit 110*a*, the driving unit 120*a* and the control unit 230*a*. Other operations of the pixel driving circuit 200*a* (such as reset, data input, and grayscale display) are similar to the pixel driving circuit 200. Likewise, in this embodiment, the second transistor M2' in the driving unit 120*a* adopts the circuit structure of the source follower, namely the gate (control terminal) of the second transistor M2' serves as the input terminal, and the source (second terminal) of the second transistor M2' serves as the output terminal.

Figure 3A:
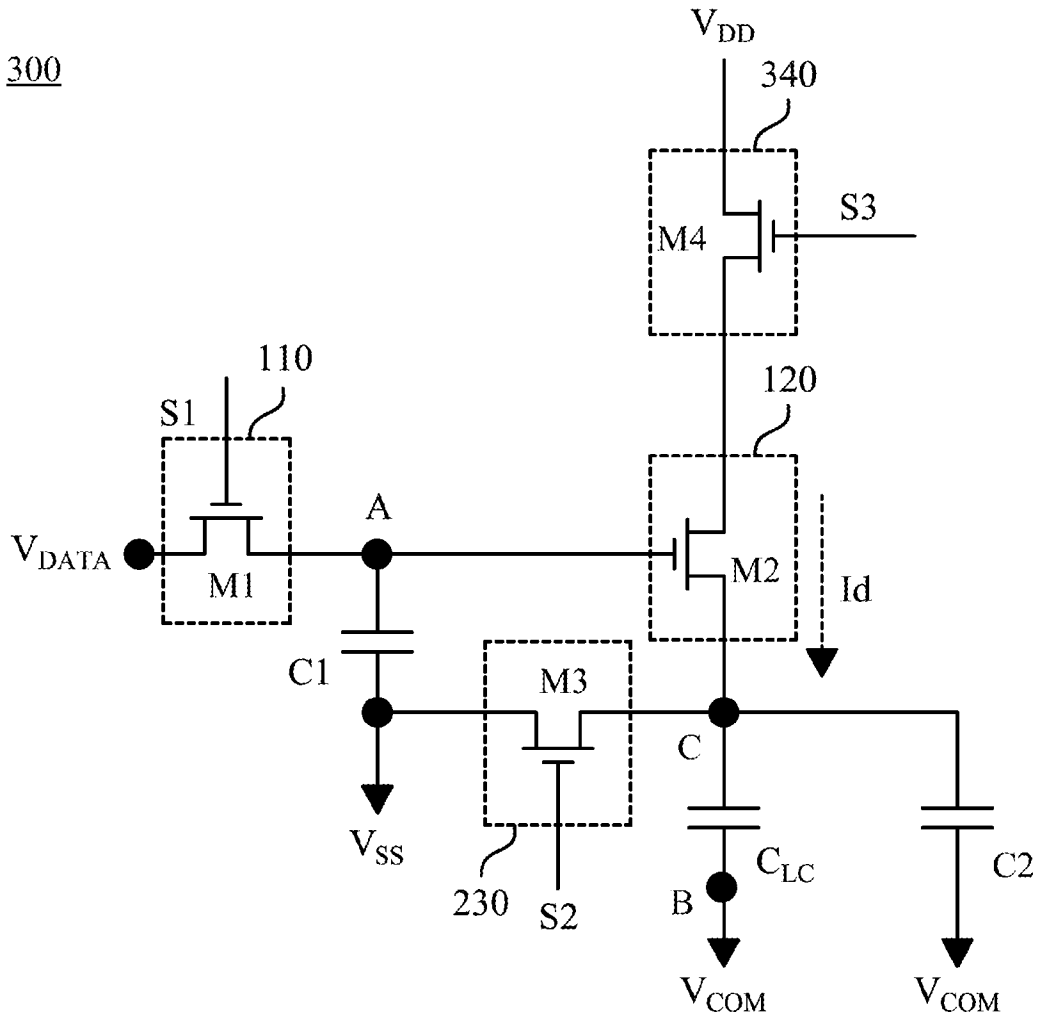
FIG. 3A is a schematic diagram of a pixel driving circuit according to another embodiment of the disclosure.
Figure 3B:
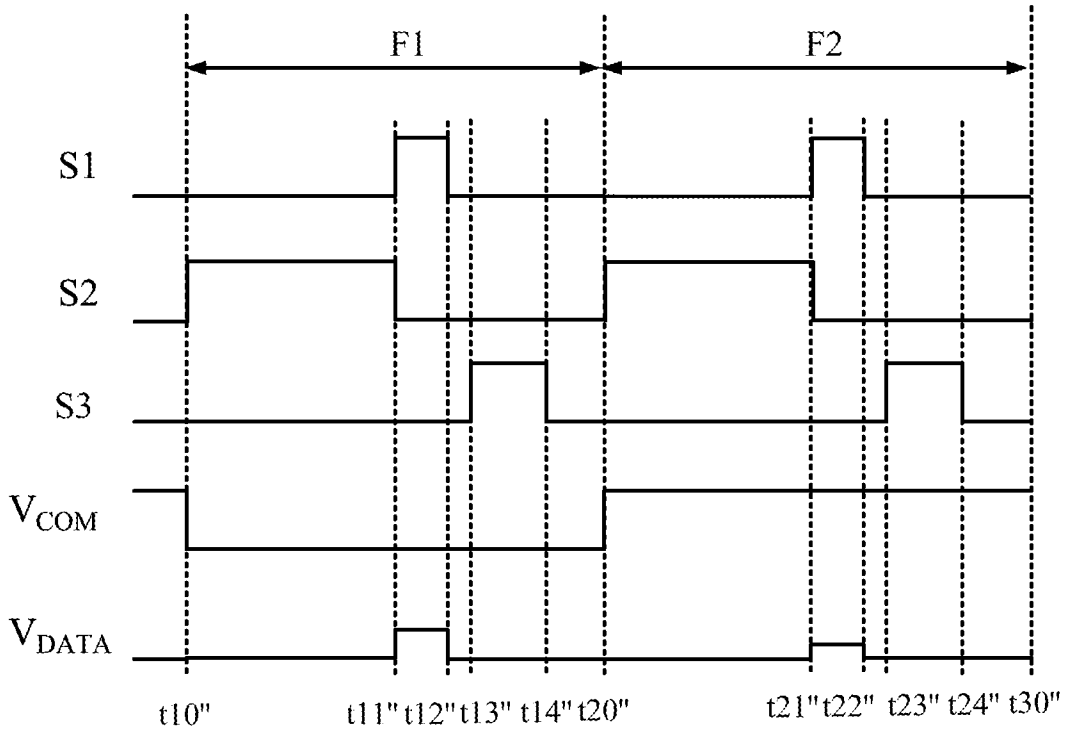
FIG. 3B is a timing diagram of the operation waveform of the pixel driving circuit shown in FIG. 3A.

Reference is made to FIG. 3A and FIG. 3B. FIG. 3A is a schematic diagram of a pixel driving circuit 300 according to another embodiment of the disclosure. FIG. 3B is a timing diagram of the operation waveform of the pixel driving circuit 300 shown in FIG. 3A. Comparing to the pixel driving circuit 200 in FIG. 2A, the pixel driving circuit 300 further includes a switch unit 340 electrically coupled to the driving unit 120 and the reference voltage $V_{DD}$. The switch unit 340 provides the reference voltage $V_{DD}$ to the driving unit 120 according to a third scanning signal S3. Furthermore, the switch unit 340 includes a fourth transistor M4. The fourth transistor M4 includes a first terminal configured to receive the reference voltage $V_{DD}$, a second terminal electrically coupled to the driving unit 120, and a control terminal configured to receive the third scanning signal S3.

Besides, as shown in FIG. 3B, in this embodiment, the scan signal S2 is enabled during the time interval t10"~t11" in the first frame F1 or the time interval t20"~t21" in the second frame F2. The third transistor M3 is turned on and the voltage of the second terminal C of $C_{LC}$ is reset to the voltage level of the reference voltage $V_{SS}$ in response to the enabled scan signal S2. The process of data input (during the time interval t11"~t12" in the first frame F1 or the time interval t21"~t22" in the second frame F2) and the emission period (during the time interval t12"~t20" in the first frame F1 or the time interval t22"~t30" in the second frame F2) are conducted subsequently.

The operations of the pixel driving circuit 300 are similar to the pixel driving circuit 200; however, in the emission period, during the time interval t11" to t12" in the first frame F1 or during the time interval t21" to t22" in the second frame F2, the fourth transistor M4 is enabled through the third scanning signal S3 and provides the reference voltage $V_{DD}$ to the second transistor M2 of the driving unit 120. Afterward, during the time interval t13"~t14" in the first frame F1 or during the time interval t23"~t24' in the second frame F2, the transistor M2 provides the driving current Id to the liquid crystal capacitor $C_{LC}$ in the active period of the third scanning signal S3. Note that, in this embodiment, the active period of the third scanning signal S3 (the time interval t13"~t14" in the first frame F1) is shorter than the emission period (the time interval t12"~t20" in the first frame F1 or the time interval t22"~t30" in the second frame F2), such that the effect induced by a sub-threshold current of the second transistor M2 to the liquid crystal capacitor $C_{LC}$ will be reduced after the liquid crystal capacitor $C_{LC}$ is charged.

For example, during the time t14"~t20" in the first frame F1, the switch unit 340 is disabled, thus sub-threshold current will ideally not be generated in the driving unit 120. With the above embodiment shown in FIG. 3A and FIG. 3B, not only the impact of the high-frequency effects of scanning signals and data signals on pixel driving circuit, but the impact of the sub-threshold current of the driving transistor on liquid crystal capacitor is reduced. In some embodiments, the active period of the switch unit 340 can be any time shorter than the emission period; examples of the present disclosure are not so limited. Likewise, in this embodiment, the second transistor M2 in the driving unit 120 adopts the circuit structure of the source follower, namely the gate (control terminal) of the second transistor M2 serves as the input terminal, and the source (second terminal) of the second transistor M2 serves as the output terminal.

Figure 3C:
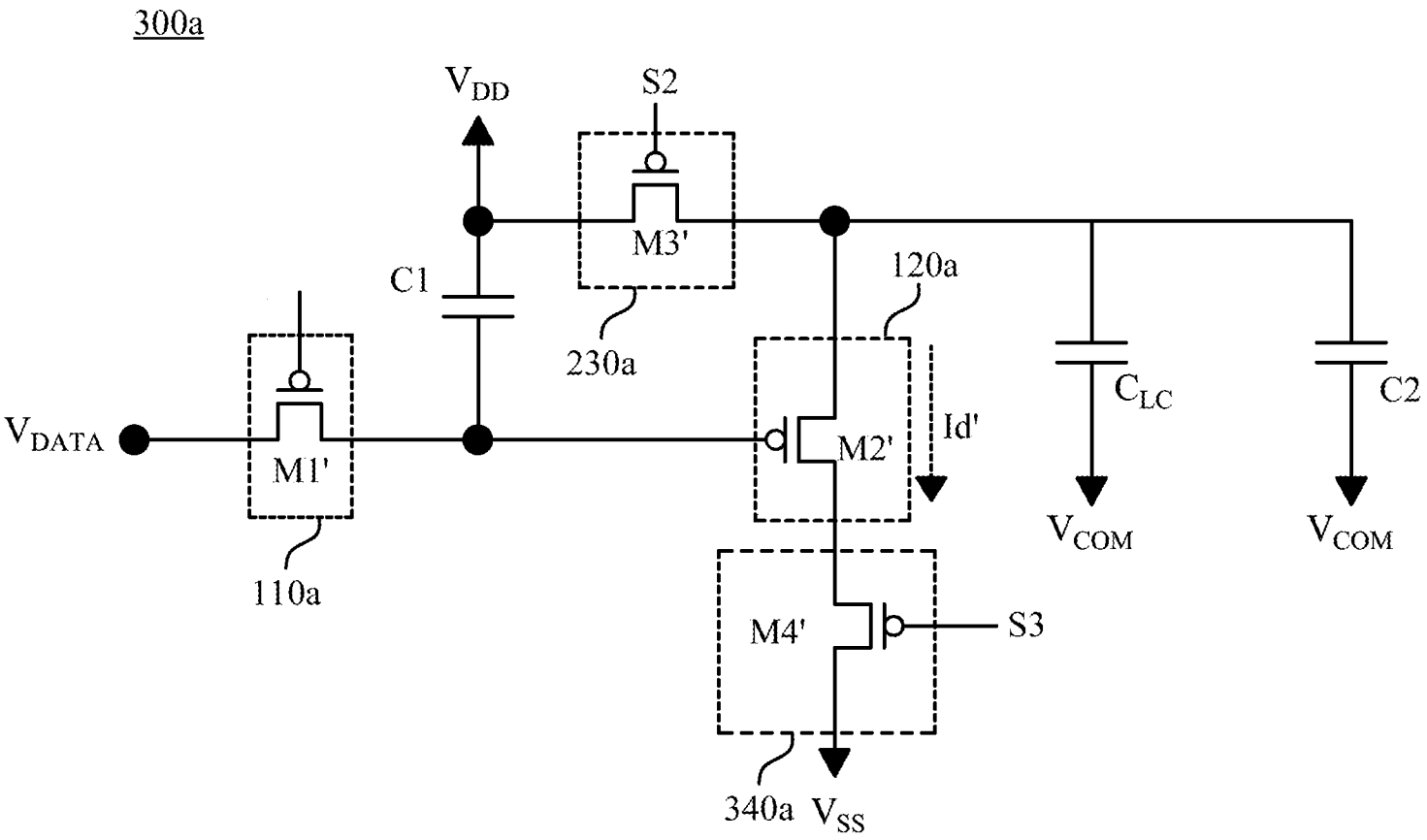
FIG. 3C is a schematic diagram of a pixel driving circuit according to another embodiment of the disclosure.
Figure 3D:
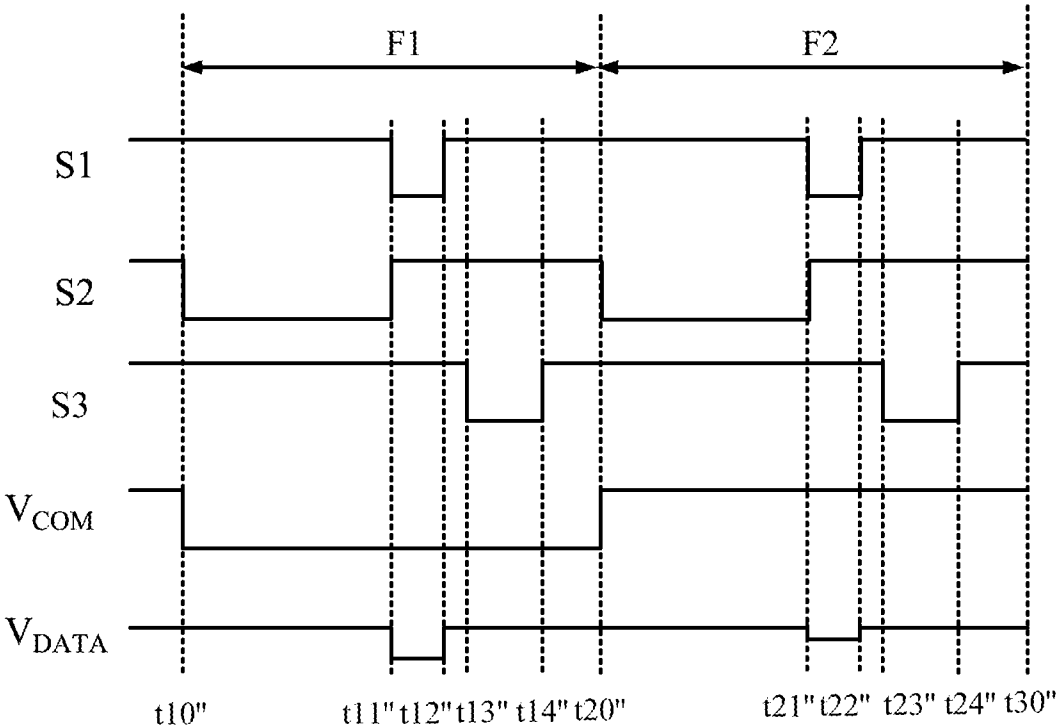
FIG. 3D is a timing diagram of the operation waveform of the pixel driving circuit shown in FIG. 3C.

Reference is made to FIG. 3C and FIG. 3D. FIG. 3C is a schematic diagram of a pixel driving circuit 300 a according to another embodiment of the disclosure. FIG. 3D is a timing diagram of the operation waveform of the pixel driving circuit 300*a* shown in FIG. 3C. The difference between the pixel driving circuit 300*a* in FIG. 3C and the pixel driving circuit 300 in FIG. 3A is mainly that the transistors M1', M2', M3', and M4' of the data input unit 110*a*, the driving unit 120*a*, the control unit 230*a* and the switch unit 340*a* are n-type transistors, namely, the control terminals of the transistor M1', M2', M3' and M4' are enabled by negative voltage level. The reference voltage $V_{DD}$ received by the first capacitor C1 is at logic-high level in this embodiment, and the reference voltage $V_{DD}$ can be logic-low level or any arbitrary level in other embodiments; examples of the present disclosure are not so limited.

Therefore, the main difference between the pixel driving circuit 300 and the pixel driving circuit 300*a* is the enabling voltage level of the transistors M1, M2, M3, M4 of the data input unit 110, the driving unit 120, the control unit 230 and the switch unit 340 and the enabling voltage level of the transistors M1', M2', M3', M4' of the data input unit 110*a*, the driving unit 120*a*, the control unit 230*a* and the switch unit 340*a*. Other operations of the pixel driving circuit 300*a* (such as reset, data input, and grayscale display) are similar to the pixel driving circuit 300. Likewise, in this embodiment, the second transistor M2' in the driving unit 120*a* adopts the circuit structure of the source follower, namely the gate (control terminal) of the second transistor M2' serves as the input terminal, and the source (second terminal) of the second transistor M2' serves as the output terminal.

Figure 4A:
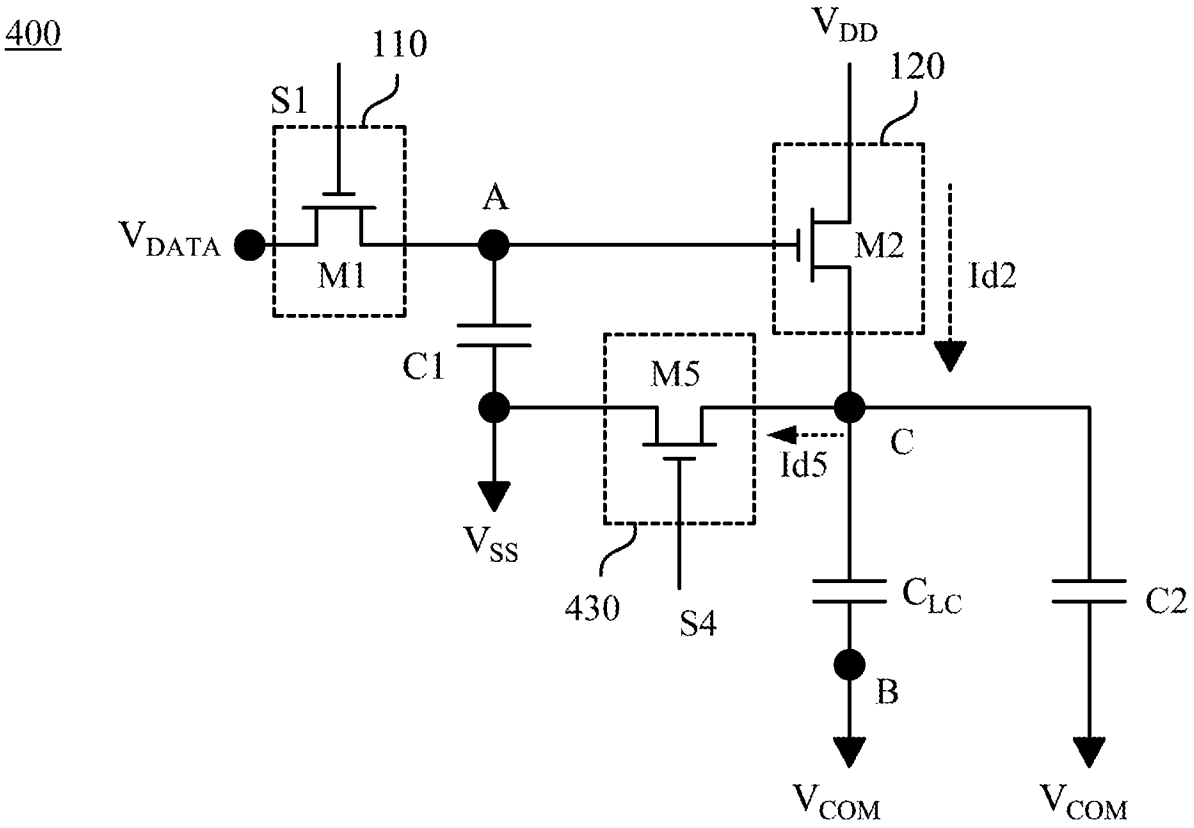
FIG. 4A is a schematic diagram of a pixel driving circuit according to another embodiment of the disclosure.
Figure 4B:
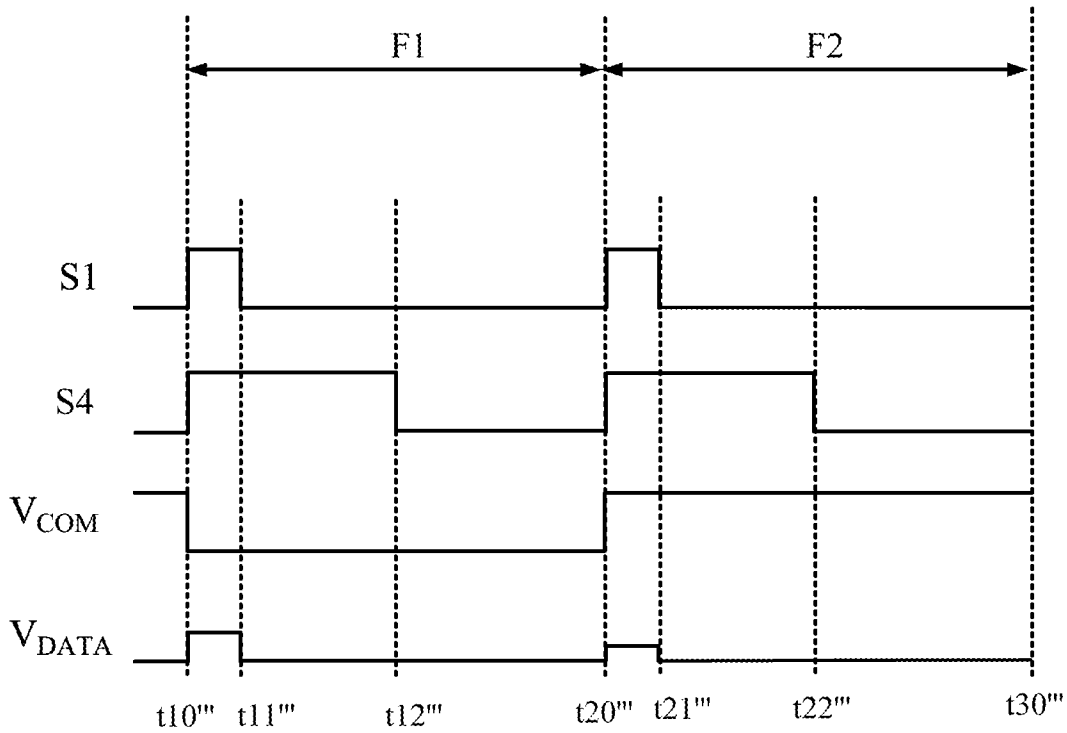
FIG. 4B is a timing diagram of the operation waveform of the pixel driving circuit shown in FIG. 4A.

Reference is made to FIG. 4A and FIG. 4B. FIG. 4A is a schematic diagram of a pixel driving circuit 400 according to another embodiment of the disclosure. FIG. 4B is a timing diagram of the operation waveform of the pixel driving circuit 400 shown in FIG. 4A. Reference is also made to FIG. 2A and FIG. 2B. Comparing to the pixel driving circuit 200, a fifth transistor M5 of a control unit 430 of the pixel driving circuit 400 has a control terminal configured to receive a fourth scanning signal S4.

In this embodiment, the fourth scanning signal S4 and the first scanning signal S1 are enabled simultaneously, or the active period of the fourth scanning signal S4 at least overlaps the active period of the first scanning signal S1 partially, such that the pixel driving circuit 400 conducts operations of data inputting and grayscale displaying at the same time. Likewise, in this embodiment, the second transistor M2 in the driving unit 120 adopts the circuit structure of the source follower, namely the gate (control terminal) of the second transistor M2 serves as the input terminal, and the source (second terminal) of the second transistor M2 serves as the output terminal. The transistor M2 and the fifth transistor M5 are identical or substantive identical in process parameters.

The driving current Id2 and Id5 flowing through the second transistor M2 and the fifth transistor M5 can be shown as:

$$\begin{aligned} Id2 &= \frac{1}{2}\mu_2 C_2 \frac{W_2}{L_2}(Vgs_2 - Vth_2)^2 \\ &= \frac{1}{2}\mu_2 C_2 \frac{W_2}{L_2}(V_{DATA} - V_C - Vth_2)^2 \end{aligned} \tag{2}$$

$$\begin{aligned} Id5 &= \frac{1}{2}\mu_5 C_5 \frac{W_5}{L_5}(Vgs_5 - Vth_5)^2 \\ &= \frac{1}{2}\mu_5 C_5 \frac{W_5}{L_5}(V_{BIAS} - V_{SS} - Vth_5)^2 \end{aligned} \tag{3}$$

where $V_{gs2}$ and $V_{gs5}$ are respectively the voltage difference of gate and source of the second transistor M2 and the fifth transistor M5, $V_{th2}$ and $V_{th5}$ are respectively the threshold voltage of the second transistor M2 and the fifth transistor M5, $W_2$ and $W_5$ are respectively the channel width of the second transistor M2 and the fifth transistor M5, $L_2$ and $L_5$ are respectively the channel length of the second transistor M2 and the fifth transistor M5, $C_2$ and $C_5$ are respectively the gate capacitance of the second transistor M2 and the fifth transistor M5, $\mu_2$ and $\mu_5$ are respectively the equivalent carrier mobility of the second transistor M2 and the fifth transistor M5, $V_{DATA}$ is the data signal, $V_C$ is the voltage of the second terminal C of the liquid crystal capacitor $C_{LC}$, $V_{BIAS}$ is the enabling voltage level of the fourth scanning signal S4 (as shown in FIG. 4B), and $V_{SS}$ is the reference voltage. The process parameters are the parameters defined in the making process of transistors, namely the above-mentioned channel width ($W_2$, $W_5$), channel length ($L_2$, $L_5$), gate capacitance ($C_2$, $C_5$), equivalent carrier mobility ($\mu_2$, $\mu_5$), and threshold voltage ($V_{th2}$, $V_{th5}$).

In this embodiment, when the transistors M2 and M5 are turned on, that is, during the time t10'''~t12''' in the first frame F1 or the time t20'''~t22''' in the second frame F2, the driving currents Id2 and Id5 flowing through the transistors M2 and M5 are the same (Id2=Id5). Also, the transistor M2 and the fifth transistor M5 are identical or substantive identical process parameters ($W_2=W_5$, $L_2=L_5$, $C_2=C_5$, $\mu_2=\mu_5$). Therefore, the above equations (2) and (3) can be further simplified to be:

$$\begin{aligned} I_{d2} &= \frac{1}{2}\mu_2 C_2 \frac{W_2}{L_2}(V_{DATA} - V_C - Vth_2)^2 \\ &= I_{d5} = \frac{1}{2}\mu_5 C_5 \frac{W_5}{L_5}(V_{BIAS} - V_{SS} - Vth_5)^2 \\ &\Rightarrow V_{DATA} - V_C = V_{BIAS} - V_{SS} \\ &\Rightarrow V_C = V_{DATA} - V_{BIAS} + V_{SS} \end{aligned} \tag{4}$$

From equation (4), the voltage of the second terminal C of the liquid crystal capacitor $C_{LC}$ is mainly affected merely by the data signal $V_{DATA}$, the enabling voltage level $V_{BIAS}$ of the fourth scanning signal S4, and the reference voltage $V_{SS}$. The voltage of the second terminal C of the liquid crystal capacitor $C_{LC}$ is not affected by the threshold voltages $V_{th2}$ and $V_{th5}$ of the second transistor M2 and the fifth transistor M5. In general, a long-term current stress induces the threshold voltage shift and affects the charging of the liquid crystal capacitor $C_{LC}$. However, in the embodiment in FIG. 4A and FIG. 4B, not only the impact of the high-frequency effects of scanning signals and data signals on pixel driving circuit, but the impact of the sub-threshold current of the driving transistor on liquid crystal capacitor is reduced.

Figure 5A:
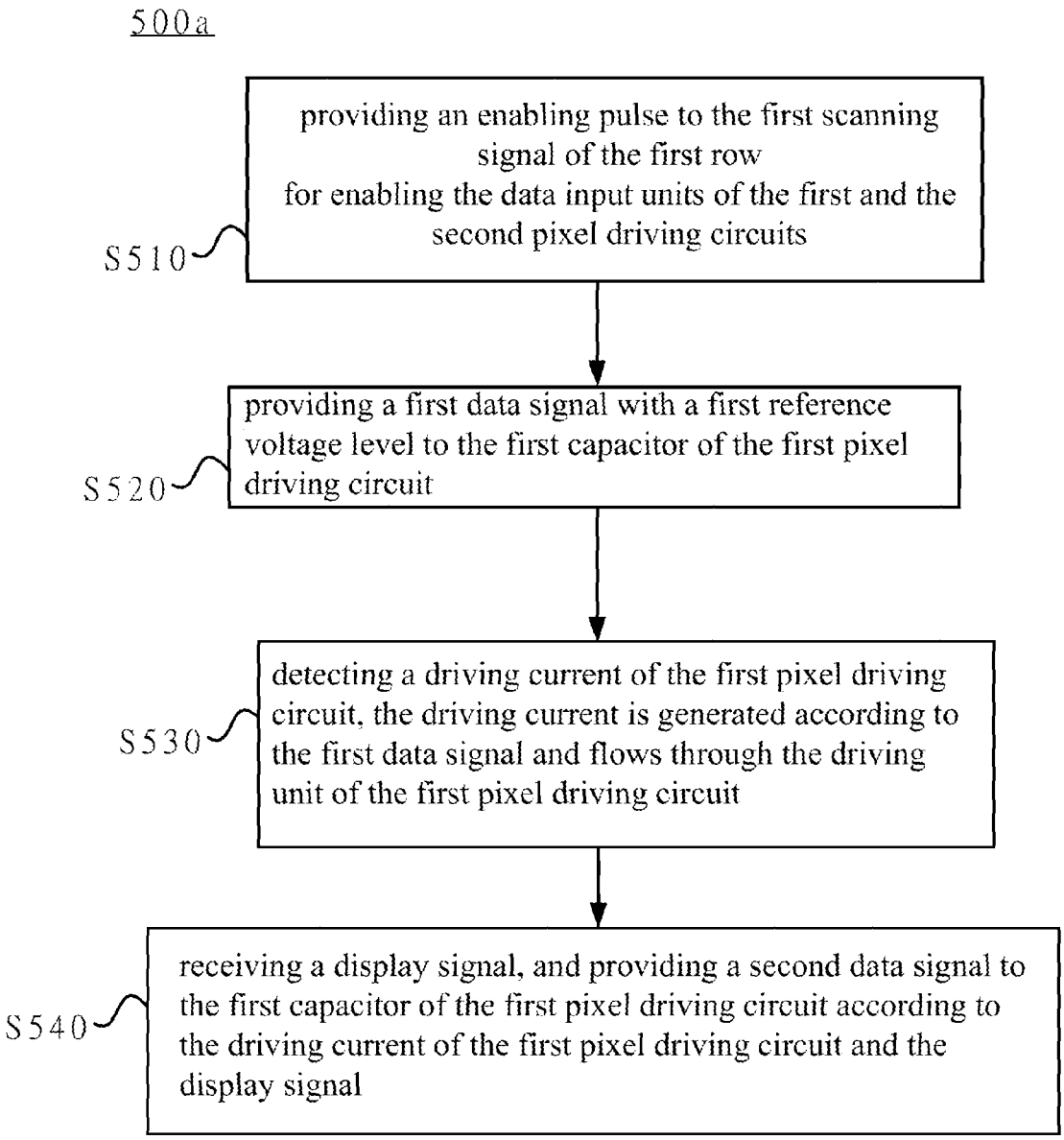
FIG. 5A is a flow chart of a driving method according to another embodiment of the disclosure.
Figure 5B:
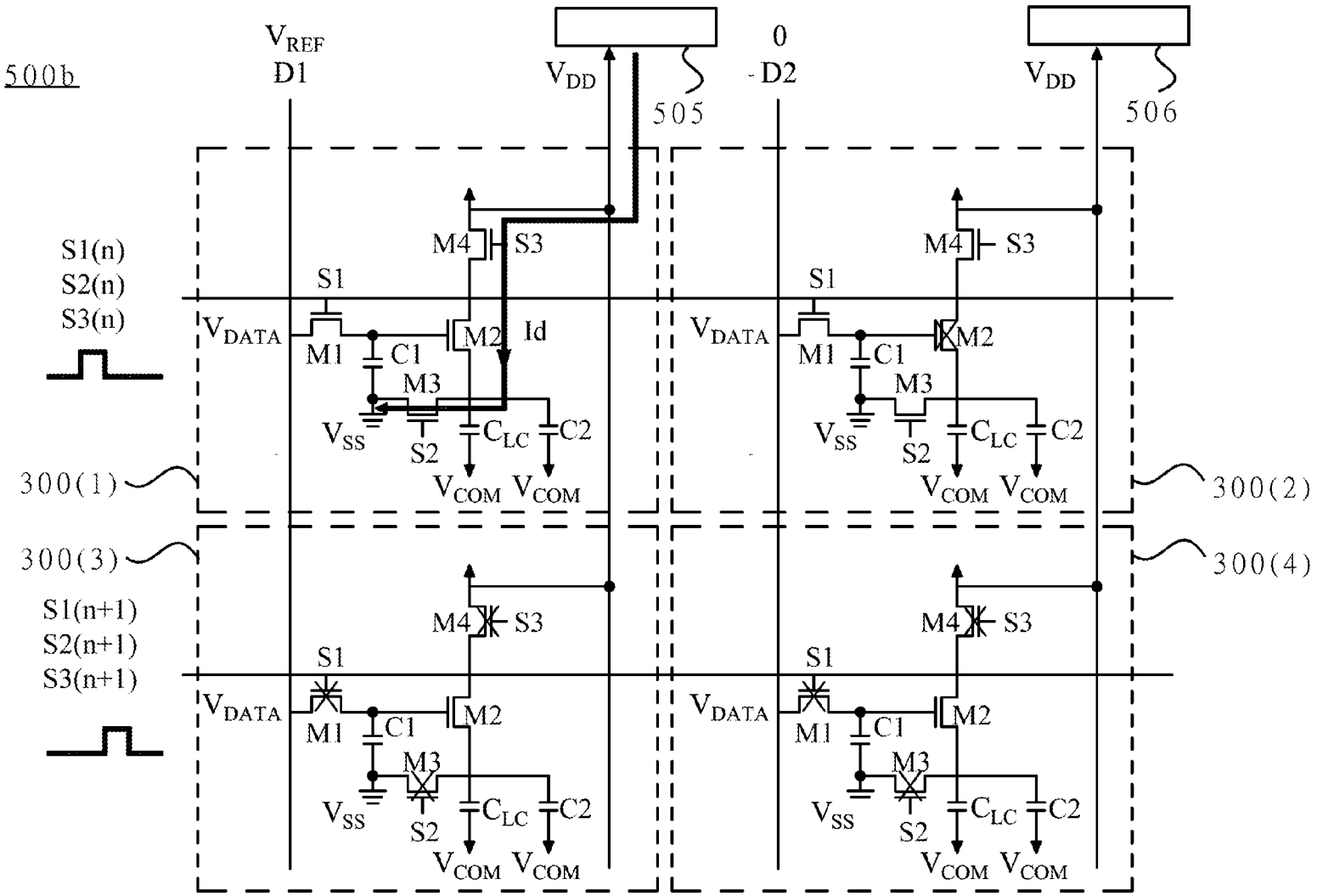
FIG. 5B is a schematic diagram of a pixel driving circuit system according to another embodiment of the disclosure.

Reference is made to FIG. 5A and FIG. 5B. FIG. 5A is a flow chart of a driving method 500*a* according to another embodiment of the disclosure. The driving method 500*a* is configured to drive the aforesaid pixel driving circuit 200, 200*a*, 300, and 300*a*. FIG. 5B is a schematic diagram of a pixel driving circuit system 500*b* according to another embodiment of the disclosure. For convenience, the pixel driving circuit system 500*b* shown in FIG. 5B is an embodiment applying the pixel driving method 500*a* to the pixel driving circuit 300. The pixel driving method 500*a* can also be applied to the pixel driving circuit 200, 200*a*, 300, 300*a*, or other equivalent pixel driving circuits; examples of the present disclosure are not so limited.

As shown in FIG. 5B, the data input unit 110 of pixel driving circuits 300(1) and 300(2) are configured to receive a first scanning signal of the first row S1(*n*), and the data input unit 110 of pixel driving circuits 300(3) and 300(4) are configured to receive a first scanning signal of the second row S1(n+1). The data input unit 110 of pixel driving circuits 300(1) and 300(3) are electrically coupled to a first data line D1, and the pixel driving circuits 300(2) and 300(4) are electrically coupled to a second data line D2. As shown in FIG. 5A, the first step of the pixel driving method 500*a* in this embodiment is step S510: providing an enabling pulse to the first scanning signal of the first row S1(*n*) for enabling the data input unit 110 of the second pixel driving circuits 300(1) and 300(2).

Step S520 of the pixel driving method 500*a:* Providing a first data signal $V_{DATA1}$ with a first voltage level $V_{REF1}$ to the first capacitor C1 of the pixel driving circuit 300(1).

Step S530 of the pixel driving method 500*a:* Detecting the driving current Id of the pixel driving circuit 300(1), wherein the driving current Id is generated according to the first data signal $V_{DATA1}$ and flows through the driving unit 120 of the pixel driving circuit 300(1). In addition, the step S530 includes enabling the scan signals S2, S3, and S4 simultaneously. In other embodiments, such as applying the pixel driving method 500*a* to the pixel driving circuit 200 and 200*a*, the step S530 includes enabling the scan signals of the first row S2(*n*) and S(3) at the same time. The pixel driving system 550*b* further includes detection units 505 and 506 electrically coupled to the reference voltage $V_{DD}$ of each rows, and a detecting unit 505 can detect the driving current Id of the pixel driving circuit 300(1).

Step S540 of the pixel driving method 500*a:* Receiving a display signal (not shown), and providing the second data signal $V_{DATA2}$ to the first capacitor C1 of the pixel driving circuit 300(1) according to the driving current Id of the pixel driving circuit 300(1). In some embodiments, the step S540 further includes a step S541' (not shown): In response to the driving current Id of the first pixel driving circuit being different to a display current of the display signal, providing the second data signal $V_{DATA2}$ to the first capacitor C1 of the pixel driving circuit 300(1) according to the difference of the driving current Id and the display current.

Moreover, as mentioned above, a long-term current stress induces the threshold voltage shift and affects the charging of the liquid crystal capacitor $C_{LC}$. Thus, even if the data signal remains the same, the driving current Id of each pixel driving circuit varies with time. The varying driving current Id affects the brightness of the LCD, or causes phenomena such as uneven pixel brightness.

The display current of the display signal provided in the step S540 positively correlates with the desired brightness of each pixel at the moment, and the display current of the display signal is equal to the driving current generated by the original threshold voltage (before threshold voltage shift) of the transistor. In response to the threshold voltage shift of the second transistor M2 of the pixel driving circuit 300(1), the driving current Id varies with time and becomes different from the display current corresponding to the first data signal $V_{DATA1}$ at the first voltage level $V_{REF1}$. In the step S540, the second data signal $V_{DATA2}$ at a second voltage level $V_{REF2}$ is provided to the first capacitor C1 of the pixel driving circuit 300(1), wherein the second voltage level $V_{REF2}$ is different from the first voltage level $V_{REF1}$.

The following is a numeric example; however, the example below is not intended to limit the present disclosure. If the display current corresponding to the first data signal $V_{DATA1}$ is 1 mA, and the actual value of the driving current Id of the pixel driving circuit 300(1) detected by the detecting unit 505 is 0.9 mA, then the threshold voltage $V_{th2}$ of the second transistor M2 has shifted (for instance, from 0.5V to 0.6V). The second data signal $V_{DATA2}$ at a second reference voltage level $V_{REF2}$ is provided to the first capacitor C1 of the pixel driving circuit 300(1), wherein the second voltage level $V_{REF2}$ is, for instance, 0.1V higher than the first voltage level $V_{REF1}$.

Therefore, the driving current Id of the pixel driving circuit 300(1) becomes the same as the display current, and the driving current Id is therefore ideally not affected by the threshold voltage shift. The threshold voltage $V_{th2}$ of the driving unit 120 of the pixel driving circuit 300(1) is compensated by modifying the data signal. In other embodiments, the shift of the threshold voltage $V_{th2}$ may be a voltage drop, and the second voltage level $V_{REF2}$ may be lower than the first voltage level $V_{REF1}$; examples of the present disclosure are not so limited.

In some embodiments, if the driving current Id of the pixel driving circuit 300(1) is still different than the display current of the display signal, then repeat the step S540 until the driving current Id of the pixel driving circuit 300(1) is equal to the display current of the display signal. The second voltage level $V_{REF2}$ may be set to be, for example, 0.05V higher than the first voltage level $V_{REF1}$ for the first time, and the driving current Id of the pixel driving circuit 300(1) will become closer, yet not equal, to the display current of the display signal. The detecting unit 505 detects the driving current Id of the pixel driving circuit 300(1) again, and in the step S540, the second voltage level $V_{REF2}$ 0.1V higher than the first voltage level $V_{REF1}$ is provided for achieving equal the driving current Id of the pixel driving circuit 300(1) and the display current.

The above-mentioned driving method 500*a* modifies the original uncompensated first data signal $V_{DATA1}$ to be the second data signal $V_{DATA2}$. The driving current Id is not affected by the threshold voltage shift of the transistor, and the driving current Id maintains equal to the display current corresponding to the display signal.

In other words, the step 540 provides the second data signal $V_{DATA2}$ to the first capacitor C1 of the pixel driving circuit 300(1) according to the driving current Id of the pixel driving circuit 300(1) and the display signal. The display signal can be, for example, an unmodified external signal, and so is the signal configured to control the grayscale display of pixels in the aforesaid system. However, the signal configured to drive pixels is practically the second data signal $V_{DATA2}$. The second data signal $V_{DATA2}$ is modified with the driving current Id to reduce the effect caused by different transistor characteristics.

In some embodiments, 500*a* further includes a step S550 (not shown). In response to the driving current Id of the pixel driving circuit 300(1) being detected, disabling the data input unit 110 of the pixel driving circuit 300(3) and 300(4), and disable the control unit 230 of the pixel driving circuit 300(3) and 300(4). In some other embodiments, in response to the driving current of the pixel driving circuit 300(1) being detected, disabling the switch unit 340 of the pixel driving circuit 300(3) and 300(4). As shown in FIG. 5B, in response to the driving current of the pixel driving circuit 300(1) being detected, the transistors M1, M2, and M4 of the pixel driving circuits 300(3) and 300(4) are disabled.

In other words, when the S1(*n*), S2(*n*), and S3(*n*) are at enabling voltage level (i.e., logic-high level in this example), the S1(n+1), S2(n+1), and S3(n+1) are at disabling voltage level. Besides, the second data line D2 is at disabling voltage level (i.e., 0V in this example). Therefore, the second transistor M2 of the pixel driving circuit 300(2) is disabled, and the driving current will only flow into the pixel driving circuit 300(1). That is, in this embodiment, only one pixel driving circuit is detected and compensated at the same time.

As shown in FIG. 5B, 300(1) is first detected and compensated, and then driving current Id of the pixel driving circuits 300(2), 300(3), and 300(4) are detected in sequence, with the threshold voltage $V_{th2}$ of the driving unit 120 of the pixel driving circuits 300(2), 300(3), and 300(4) compensated one after the other. In other embodiments, the order of detection can be arbitrarily adjusted, such as the pixel driving circuit sequence 300(1), 300(3), 300(2), 300(4), or the pixel driving circuit sequence 300(4), 300(3), 300(2), 300(1). The order of detection is not limited to the pixel driving circuit sequence 300(1), 300(2), 300(3), 300(4).

To conclude, with one pixel driving circuit embodiment of this disclosure, the impact of the high-frequency effects of scanning signals and data signals on pixel driving circuit is reduced. With another pixel driving circuit embodiment of this disclosure, not only the impact of the high-frequency effects of scanning signals and data signals on pixel driving circuit, but the impact of the sub-threshold current of the driving transistor on liquid crystal capacitor is reduced. Furthermore, the threshold voltage of the driving unit compensated with the pixel driving circuit embodiment of this disclosure.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A pixel driving circuit, comprising:

a first capacitor, comprising a first terminal and a second terminal, the first terminal of the first capacitor being configured to receive a first reference voltage;

a data input unit electrically coupled to the first capacitor, the data input unit being configured to input a data signal to the second terminal of the first capacitor according to a first scanning signal;

a liquid crystal capacitor, comprising a first terminal and a second terminal, the first terminal of the liquid crystal capacitor being configured to receive the first reference voltage;

a driving unit electrically coupled to the data input unit, the second terminal of the first capacitor and the second terminal of the liquid crystal capacitor, in response to the data input unit being disabled, the driving unit being configured to control the voltage of the second terminal of the liquid crystal capacitor according to the data signal; and a control unit electrically coupled to the driving unit, the control unit being configured to generate a second scanning signal for resetting the voltage of the second terminal of the liquid crystal capacitor.

2. The pixel driving circuit of claim 1, wherein the data input unit comprises a first transistor, the first transistor comprises:

a first terminal configured to receive the data signal;

a second terminal electrically coupled to the second terminal of the first capacitor and the driving unit; and a control terminal configured to receive the first scanning signal.

3. The pixel driving circuit of claim 1, wherein the driving unit comprises a second transistor, the second transistor comprises:

a first terminal configured to receive the second scanning signal;

a second terminal electrically coupled to the second terminal of the liquid crystal capacitor; and a control terminal electrically coupled to the second terminal of the first capacitor and the data input unit.

4. The pixel driving circuit of claim 3, the control unit is configured to generate the second scanning signal for resetting the second terminal of the liquid crystal capacitor to a default level via the second transistor.

5. A pixel driving circuit, comprising:

a first capacitor, comprising a first terminal and a second terminal, the first terminal of the first capacitor being configured to receive a first reference voltage;

a data input unit electrically coupled to the first capacitor, wherein the data input unit is configured to input a data signal to the second terminal of the first capacitor according to a first scanning signal;

a liquid crystal capacitor, comprising a first terminal and a second terminal, the first terminal of the liquid crystal capacitor being configured to receive the first reference voltage;

a control unit electrically coupled to the liquid crystal capacitor, the control unit being configured to receive the first reference voltage, for controlling the voltage of the second terminal of the liquid crystal capacitor according to a second scanning signal; and a driving unit electrically coupled to the data input unit, the second terminal of the first capacitor and the second terminal of the liquid crystal capacitor, the driving unit being configured to control the voltage of the second terminal of the liquid crystal capacitor according to the data signal.

6. The pixel driving circuit of claim 5, wherein the control unit comprises a third transistor, the third transistor comprises:

a first terminal electrically coupled to the first terminal of the first capacitor;

a second terminal electrically coupled to the driving unit and the second terminal of the liquid crystal capacitor; and a control terminal configured to receive the second scanning signal.

7. The pixel driving circuit of claim 6, further comprising:

a switch unit electrically coupled to the driving unit and a second reference voltage, wherein the switch unit is configured to provide the second reference voltage to the driving unit according to a third scanning signal.

8. The pixel driving circuit of claim 7, wherein the switch unit comprises a fourth transistor, the fourth transistor comprises:

a first terminal electrically configured to receive the second reference voltage;

a second terminal electrically coupled to the driving unit; and a control terminal configured to receive the third scanning signal.

9. The pixel driving circuit of claim 5, wherein the control unit comprises a fifth transistor, the fifth transistor comprises:

a first terminal configured to receive the first reference voltage;

a second terminal electrically coupled to the second terminal of the liquid crystal capacitor; and a control terminal configured to receive a fourth scanning signal, wherein an active period of the fourth scanning signal at least overlaps the active period of the first scanning signal partially.

10. The pixel driving circuit of claim 5, wherein the data input unit comprises a first transistor, the first transistor comprises:

a first terminal configured to receive the data signal;

a second terminal electrically coupled to the second terminal of the first capacitor and the driving unit; and a control terminal configured to receive the first scanning signal.

11. The pixel driving circuit of claim 10, wherein the control unit comprises a third transistor, the third transistor comprises:

a first terminal electrically coupled to the first terminal of the first capacitor;

a second terminal electrically coupled to the driving unit and the second terminal of the liquid crystal capacitor; and a control terminal configured to receive the second scanning signal.

12. The pixel driving circuit of claim 10, wherein the control unit comprises a fifth transistor, the fifth transistor comprises:

a first terminal configured to receive the first reference voltage;

a second terminal electrically coupled to the second terminal of the liquid crystal capacitor; and a control terminal configured to receive a fourth scanning signal, wherein an active period of the fourth scanning signal at least overlaps the active period of the first scanning signal partially.

13. The pixel driving circuit of claim 5, wherein the driving unit comprises a second transistor, the second transistor comprises:

a first terminal configured to receive a second scanning signal;

a second terminal electrically coupled to the second terminal of the liquid crystal capacitor; and a control terminal electrically coupled to the second terminal of the first capacitor and the data input unit.

14. The pixel driving circuit of claim 13, wherein the control unit comprises a third transistor, the third transistor comprises:

a first terminal electrically coupled to the first terminal of the first capacitor;

a second terminal electrically coupled to the driving unit and the second terminal of the liquid crystal capacitor; and a control terminal configured to receive the second scanning signal.

15. The pixel driving circuit of claim 13, wherein the control unit comprises a fifth transistor, the fifth transistor comprises:

a first terminal configured to receive the first reference voltage;

a second terminal electrically coupled to the second terminal of the liquid crystal capacitor; and a control terminal configured to receive a fourth scanning signal, wherein an active period of the fourth scanning signal at least overlaps the active period of the first scanning signal partially.

16. The pixel driving circuit of claim 13, wherein the control terminal of the second transistor is configured to serve as an input terminal, the second terminal of the second transistor serves as an output terminal of a source follower.

17. A driving method for driving a first, a second, a third, and a fourth pixel driving circuits as claimed in claim 5, wherein the data input units of the first and the second pixel driving circuits are configured to receive a first scanning signal of a first row, the data input units of the third and the fourth pixel driving circuits are configured to receive a first scanning signal of a second row, the data input units of the first and the third pixel driving circuits are electrically coupled to a first data line, and the data input units of the second and the fourth pixel driving circuits are electrically coupled to a second data line, the driving method comprising:

providing an enabling pulse to the first scanning signal of the first row for enabling the data input units of the first and the second pixel driving circuits;

providing a first data signal with a first voltage level to the first capacitor of the first pixel driving circuit;

detecting a driving current of the first pixel driving circuit, wherein the driving current is generated according to the first data signal and flows through the driving unit of the first pixel driving circuit; and receiving a display signal, and providing a second data signal to the first capacitor of the first pixel driving circuit according to the driving current of the first pixel driving circuit and the display signal.

18. The driving method of claim 17, where in the step, receiving a display signal, and providing a second data signal to the first capacitor of the first pixel driving circuit according to the driving current of the first pixel driving circuit and the display signal, comprising:

in response to the driving current of the first pixel driving circuit being different to a display current of the display signal, providing the second data signal to the first capacitor of the first pixel driving circuit according to a difference between the driving current and the display current.

19. The driving method of claim 17, further comprising:

in response to the driving current of the first pixel driving circuit being detected, disabling the data input units of the third and the fourth pixel driving circuit.

20. The driving method of claim 17, further comprising:

in response to the driving current of the first pixel driving circuit being detected, disabling the control units of the third and the fourth pixel driving circuit.

* * * * *